United States Patent [19]

Anthony

[11] 3,981,250

[45] Sept. 21, 1976

[54] ADJUSTABLE SHELVING

[76] Inventor: Russell E. Anthony, 1575 Chanticleer, Anaheim, Calif. 92802

[22] Filed: Aug. 18, 1975

[21] Appl. No.: 605,749

[52] U.S. Cl. ..... 108/106; 108/144; 108/156; 248/188

[51] Int. Cl.[2] ..... A47B 9/00

[58] Field of Search ..... 108/106, 107, 144, 156; 248/188, 221 F, 228, 223; 211/176, 153

[56] References Cited

UNITED STATES PATENTS

| | | | |
|---|---|---|---|
| 1,996,518 | 4/1935 | Levene et al. | 108/107 |
| 2,935,210 | 5/1960 | Cohen | 108/106 X |
| 3,021,013 | 2/1962 | Shivek | 108/152 X |
| 3,065,860 | 11/1962 | Swanson | 211/153 |
| 3,747,540 | 7/1973 | Salkoff et al. | 108/156 |
| 3,754,728 | 8/1973 | Bowman | 108/156 X |
| 3,797,182 | 3/1974 | Eichstaedt | 248/228 X |
| 3,851,600 | 12/1974 | Kohl | 108/144 |

*Primary Examiner*—Ramon S. Britts
*Assistant Examiner*—Darrell Marquette
*Attorney, Agent, or Firm*—Gausewitz, Carr & Rothenberg

[57] ABSTRACT

This invention provides an adjustable shelf device in which shelves are provided with notches defined by intersecting edges at their corners, and with elements extending across the notches to cooperate with the edges in defining openings. Extending through each of the openings is a support post being in the form of a structural angle, with its outer surfaces engaging the edges of the notch. A releasable friction member is in the opening for locking the support post and the shelf member together.

15 Claims, 10 Drawing Figures

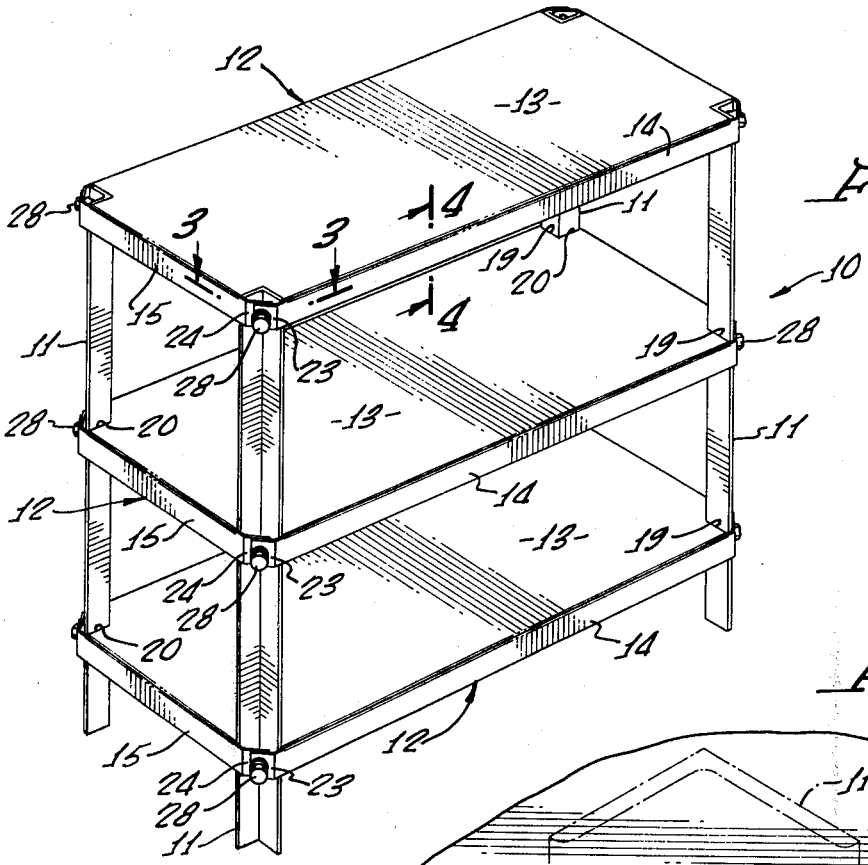
FIG. 1.
FIG. 2.
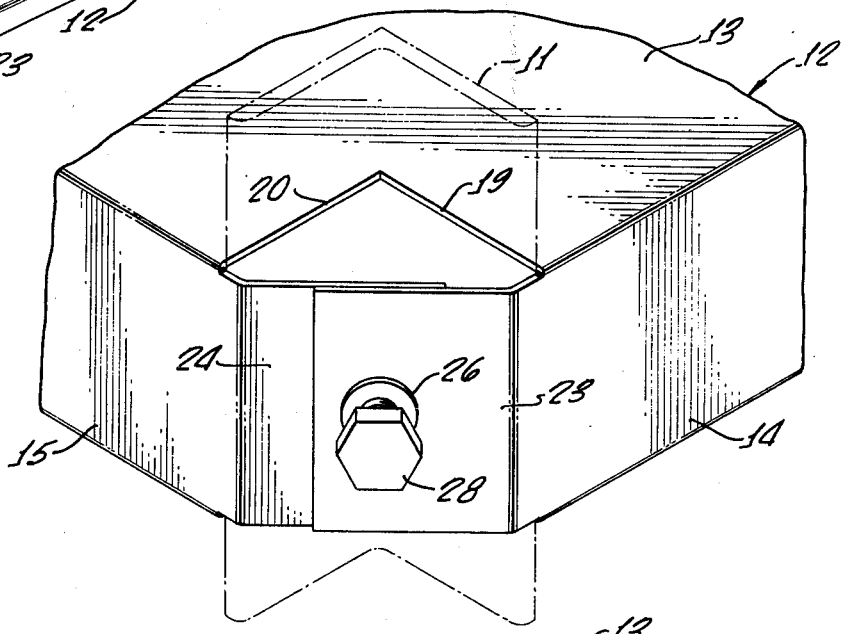
FIG. 3.
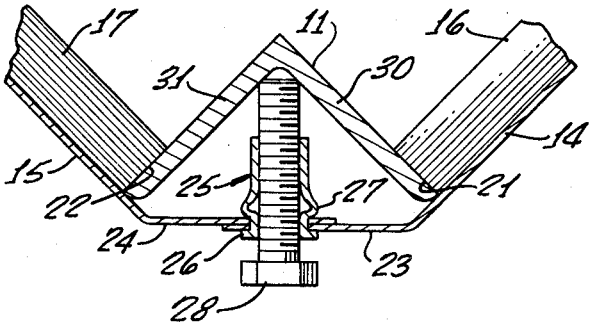
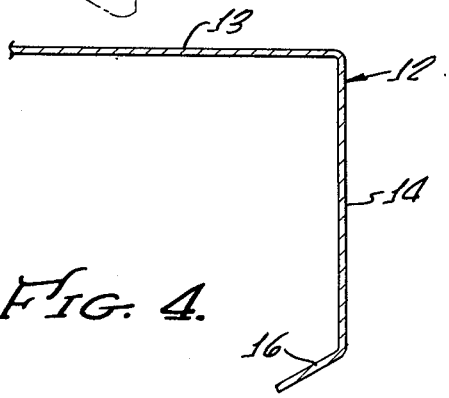
FIG. 4.

FIG. 8.
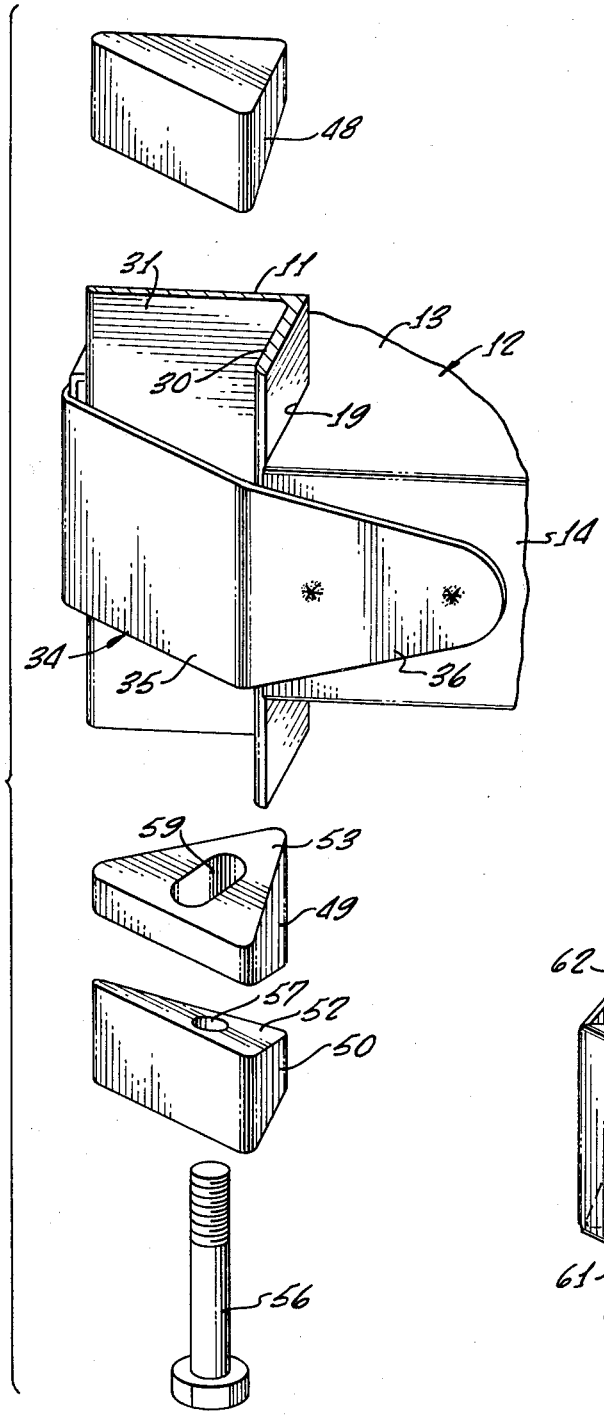
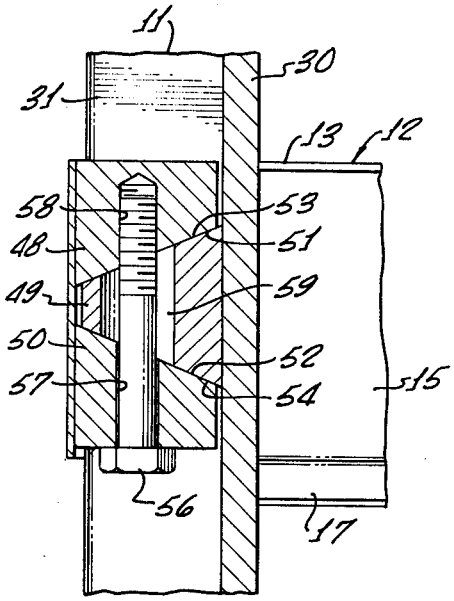
FIG. 9.
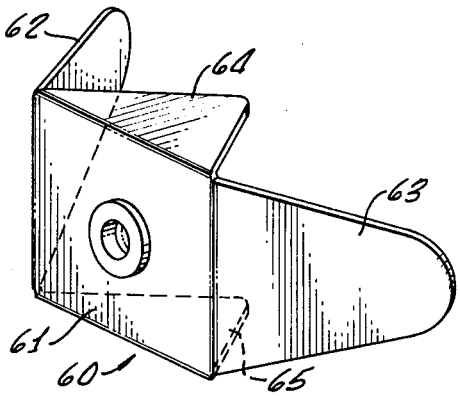
FIG. 10.

ADJUSTABLE SHELVING

BACKGROUND OF THE INVENTION

1. Field of the Invention:

This invention relates to an adjustable shelf arrangement.

2. Description of the Prior Art:

A number of different kinds of shelving supports have been designed and used in the past, frequently providing for adjustability of positions of the shelves. Typically there are support posts in the form of square channels, round tubing or the like which are engaged by specially designed clamps at the corner of the shelves. By appropriate manipulation of locking devices, the shelves may be positioned in selected locations. Although these shelf units provide satisfactory support and adjustment, invariably they incorporate complexity of design which unduly increase their cost of manufacture. Moreover, the locking devices may be relatively difficult and time-consuming to operate, in which event it is not a simple matter to adjust the shelves to different positions. Assembly of the shelves, supports and clamps also may be somewhat awkward and take undue amounts of time. Some types of shelf supports do not provide for universal adjustment of the shelves.

SUMMARY OF THE INVENTION

The present invention provides a greatly simplified support shelf device which is easily manufactured and assembled at a very low cost. Nevertheless, the device provides a firm and stable support for the shelves and allows universal adjustment of shelf positions. The shelves are released, moved and locked in position in a simple and rapid operation.

This is accomplished by shelves which are provided with notches at their corners, the notches including two edges at right angles which meet at their inner ends and at their outer ends extend to the periphery of the shelf. A depending flange extends around the perimeter of the shelf, with a narrower inwardly directed flange portion at its lower edge. The latter flange has edges vertically aligned with the edges of the shelf, forming a portion of the boundary of the notch.

An element extends across the notch at a 45° angle to define an opening which receives the support posts for the unit. These posts may be structural angles with their outer surfaces substantially complementarily engaging the edges of the shelf and the flange. A friction member extends from the element across the notch to the inner surface of the angle to provide the adjustable locking arrangement.

The element extending across the notch may be continuations of the depending flange of the shelf, being in two portions overlapped at the central part of the element. The friction device may include a nut in the form of a sleeve which extends through an opening in the overlapped portions of the flange, with an enlargement on either side to hold the parts together. A screw extends through the nut with the end of its shank bearing against the inner surface of the support post adjacent the intersection of the inner surface portions. Merely tightening the screw locks the connection between the support posts and the shelf.

The element across the notch also may be in the form of a flat sheet member having end parts spot welded to the flange of the support shelf. The friction member may be wedge devices received in the opening of the notch with threaded elements used to draw the wedge elements into position where they are forced into tight engagement with the inner surface of the support posts and the inner surface of the element across the notch.

BRIEF DESCRIPTION OF THE DRAWINGS:

FIG. 1 is a perspective view of a support shelf assembly in accordance with the present invention;

FIG. 2 is an enlarged fragmentary perspective view of a corner portion of the support shelf;

FIG. 3 is an enlarged sectional view, taken along line 3—3 of FIG. 1;

FIG. 4 is an enlarged sectional view, taken along line 4—4 of FIG. 1;

FIG. 8 is a fragmentary perspective exploded view of an arrangement using a different wedge assembly for locking the shelf and post;

FIG. 9 is a longitudinal sectional view of the arrangement of FIG. 8 in the assembled and locked position; and FIG. 10 is a perspective view of a modified corner element which includes a surface extending across the upper and lower ends of the notch opening.

DESCRIPTION OF THE PREFERRED EMBODIMENT

Figure 5:
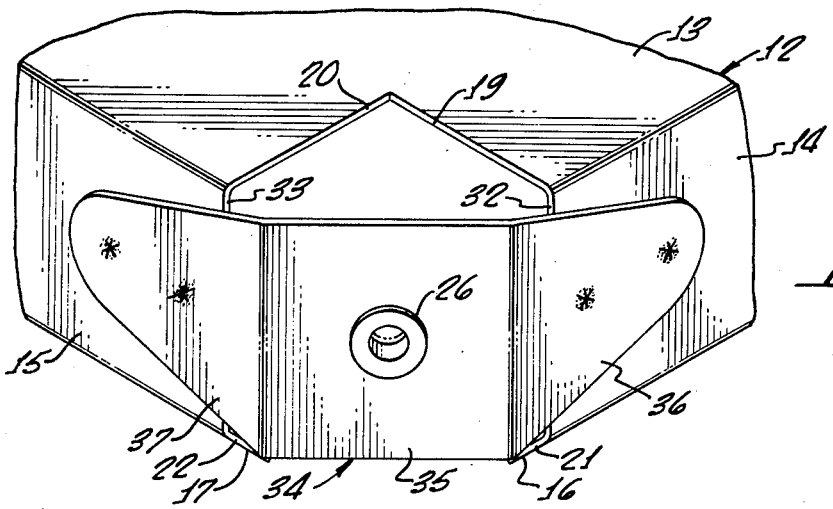
FIG. 5 is an enlarged fragmentary perspective view of a corner portion of the shelf, using a modified-type of element extending across the notch.

The shelf assembly 10 of FIG. 1, utilizing the arrangement of this invention, includes four support posts 11, carrying spaced horizontal shelves 12. Each of the shelves 12 is a unitary sheet metal element of rectangular configuration having a principal flat horizontal panel 13 from the edges of which side and end flanges 14 and 15, respectively, extend downwardly at right angles. Narrower flanges 16 and 17 are at the lower edges of the flanges 14 and 15, extending inwardly at an obtuse angle so that these smaller flanges are inclined downwardly. This means that the lower flanges will not provide a surface upon which material can be trapped and enables the shelving unit to be used in the food processing industry.

As indicated in FIG. 2, each corner of the horizontal shelf panel 13 is cut away so as to provide a notch bounded by intersecting straight edges 19 and 20. The edge 19 is parallel to the end flange 15 while the edge 20 is parallel to the side flange 14, so that the edges 19 and 20 meet at right angles. Thus, each of those notch edges is perpendicular to the peripheral edge of the panel 13 to which it extends.

The lower narrow flanges 16 and 17 also are cut away in vertical alignment with the edges 19 and 20 of the horizontal panel 13. This provides the flange 16 with an edge 21 which is immediately below the edges 19 of the panel 13 and at right angles to the side flange 14. Similarly, there is an end edge 22 of the lower flange 17 beneath the edge 20 of the panel 13 and perpendicular to the end flange 15. The edges 21 and 22 are at right angles to each other.

The adjoining ends of the side flanges 14 and 15 at the corners of the shelf 12 are bent inwardly at 45° just beyond the edges 19 and 20 of the notch in the horizontal panel 13. This provides end sections 23 and 24 of the side and end flanges 14 and 15, respectively, which overlap at the central part of the corner. An opening is formed in the overlapped sections 23 and 24 for receiving the shank of a fastening element that holds these two element together. This is accomplished suitably by the nut sleeve 25 of a fastener known as a "Rivnut," marketed by B. F. Goodrich Aerospace & Defense Products, which has a flange 26 on the outside of section 23 and is collapsed to form an upset 27 on the inside of the corner section 24. The inner end portion of the sleeve 25 is threaded and receives the shank of a screw 28 that extends through the sleeve.

Each support post 11 is a structural angle, thereby having webs 30 and 31 which meet at right angles. The openings at the corners of the shelves 12 are dimensioned to receive the support posts 11 with their concave sides facing outwardly. When so positioned, the outside surfaces of the webs 30 and 31 are substantially complementarily engaged by the edges 19 and 20 of the horizontal panel 13. These surfaces also are engaged by the edges 21 and 22, respectively, of the lower flanges 16 and 17.

The shelves 12 are secured at desired heights merely by tightening the screws 28 to force the ends of the screws against the webs 30 and 31 of the support posts 11 at the central portions of these posts adjacent where the webs intersect. This creates a frictional force between the end of the screw and the support posts 11, as well as between the edges of the horizontal panel 13 and of the lower flanges 16 and 17 and the support posts. This securely locks the shelf in place with the simple screw tightening operation. The engagement of each post 11 at the spaced locations provided by the edges 19 and 20 and the edges 21 and 22 of the shelf 12 results in a stable connection between the shelf and the post. The end of the screw 28 presses inwardly at a location intermediate the two upper edges 19 and 20 and the lower edges 21 and 22 so as to firmly hold the post and shelf together.

The shelves may be moved to other locations simply by loosening the screws 28 allowing the shelves to be slid upwardly or downwardly relative to the support posts 11.

In the embodiment of FIG. 5, the end sections 23 and 24 of the flanges 14 and 15 are removed at the edges of the cutouts in the panel 13. This produces end edges 32 and 33 on the side and end flanges 14 and 15, which are continuations of the corner panel edges 19 and 20, as well as the edges 21 and 22 of the lower flanges 16 and 17. There is then fastened over each corner a sheet metal plate 34 having a flat central portion 35 at a 45° angle to the flanges 14 and 15 of the shelf. Tapered ends 36 and 37 of the plate 34 overlie the flanges 14 and 15, respectively, and are spot welded to them. The sleeve 25 of a suitable fastener, such as that used in the previously described embodiment, is connected to the central portion 35 of the plate 34. This enables the embodiment of FIG. 5 to be utilized with the support posts 11 in the same manner as in the previously described arrangement.

Figure 6:
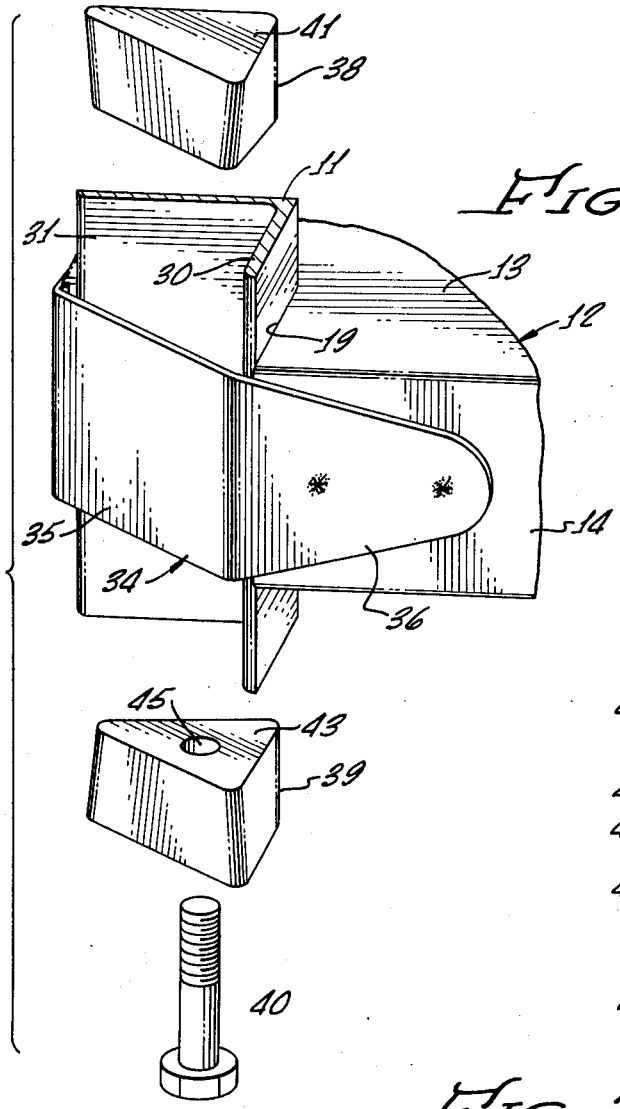
FIG. 6 is an exploded fragmentary perspective view showing an arrangement for locking the shelf to the support posts by wedges.
Figure 7:
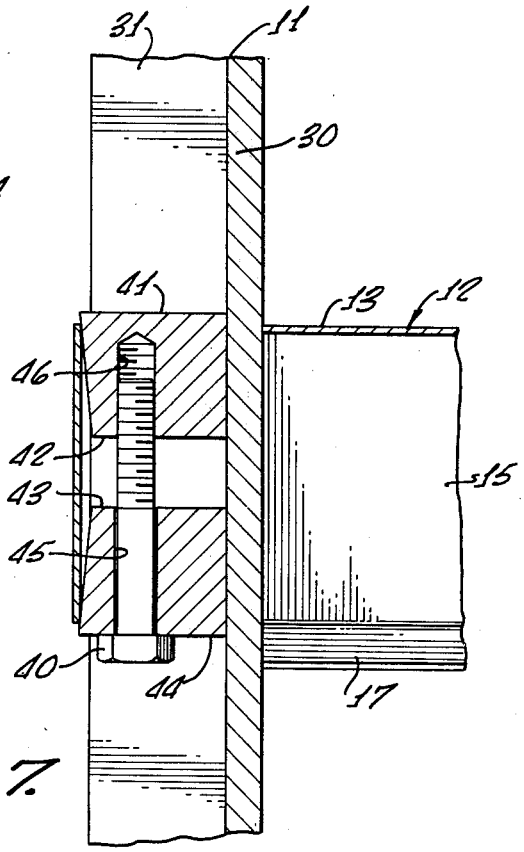
FIG. 7 is a longitudinal sectional view of the arrangement of FIG. 6 in the assembled and secured position.

In FIGS. 6 and 7, again the welded corner plate 34 is used, but in this instance the fastener of the previously described arrangement is replaced with wedges 38 and 39, held together by a screw 40. The two wedges have flat triangular ends and tapering sides, and are positioned oppositely. In other words, the top surface 41 of the upper wedge 38 is larger than the bottom surface 42 of that wedge. The upper surface 43 of the wedge 39 is smaller in dimension than that of the bottom surface 44. The wedges enter the space between the support posts 11 and the corner plate 34, as seen in FIG. 7, being drawn together by the screw 40. The latter element extends through an unthreaded opening 45 in the lower wedge 39, with the threaded screw shank being received in a tapped hole 46 in the upper wedge 38. Consequently, tightening the screw 40 draws the wedges together, causing them to bear firmly against the end plate 34 and the adjacent surfaces of the support post 11. This creates a frictional force retaining the shelf 12 in its selected position. When the screw 40 is loosened, on the other hand, the shelf 12 is freely slidable to a different position.

Three wedges are used in the arrangement of FIGS. 8 and 9, including an upper wedge 48, an intermediate wedge 49 and a lower wedge 50. These wedges are triangular in shape and made slightly smaller in dimension than the space defined by the corner plate 34 and the webs 30 and 31 of the support posts 11. The bottom surface 51 of the upper wedge 48 tapers in one direction and the upper surface 52 of the lower wedge 50 tapers in the opposite direction. Both the upper surface 53 and the lower surface 54 of the intermediate wedge 49 are tapered so that these two surfaces are convergent. A screw 56 is extended through an unthreaded opening 57 in the lower wedge 50 with its threaded end being received in a tapped opening 58 in the upper wedge 48. The central portion of the screw 56 extends through a clearance slot 59 in the central wedge 49. Therefore, there is movement permitted the central wedge relative to the upper and lower wedges 48 and 50. As a result of the reaction along the tapered surfaces, as the screw 56 is tightened, the central wedge 49 will be forced laterally against the webs 30 and 31 of the support posts 11. At the same time, the upper and lower wedges 48 and 50 are forced outwardly against the central portion 35 of the corner plate 34, thereby providing the frictional force that will hold the shelf 12 in the desired position.

Illustrated in FIG. 10 is a modified corner plate 60 having a central portion 61 and tapered end portions 62 and 63 similar to the central portion 35 and tapered ends 36 and 37 of the corner plate 34. However, the corner plate 60 includes also triangular flanges 64 and 65 extending horizontally from the upper and lower edges, respectively, of the central part 61. The flanges 64 and 65 fit within the space provided by the angular webs 30 and 31 of the support posts 11, thereby closing off this area and providing a neater appearance.

The foregoing detailed description is to be clearly understood as given by way of illustration and example only, the spirit and scope of this invention being limited solely by the appended claims.

I claim:

1. An adjustable shelf device comprising at least one member defining a support surface, said member having a plurality of corners, each of said corners including first and second edges extending from outer ends thereof at the periphery of said support surface to intersecting inner ends thereof so as to define a notch, an element extending across said notch of each of said corners between said outer ends of said edges so as to cooperate with said edges in defining an opening, a post means received in each of said openings, said post means comprising a structural angle having an L-shaped cross section having outer surfaces on one side in juxtaposition with said edges, and friction means between said element and the inner surface of said structural angle for releasably holding said member in a fixed relationship with said post means.

2. A device as recited in claim 1 in which said member includes a depending flange along the periphery of said support surface, said elements extending from said depending flange at each of said corners.

3. A device as recited in claim 2 in which each of said elements is a sheet metal member having a central portion extending across said notch, and opposite end portions secured to said depending flange on either side of said notch.

4. A device as recited in claim 3 in which said support surface is substantially rectangular, said first and second edges extend substantially perpendicularly from said periphery of said surface, and said element is substantially at a 45° angle to said first and second edges.

5. A device as recited in claim 3 in which said opposite end portions overlap and are welded to said depending flange.

6. A device as recited in claim 3 in which said sheet metal member includes a substantially triangular flange extending from top and bottom edges thereof for closing the space between said sheet metal member and said inner surface of said post means.

7. A device as recited in claim 2 in which said element comprises a continuation of said depending flange at each of said corners, said element being in two parts overlapped at the central portion thereof.

8. A device as recited in claim 7 in which said friction means includes a nut member, said nut member extending through said overlapped parts of said element, and having flange and upset means thereon for holding said nut member to said element and said overlapped portions together, and a screw extending through said nut member and to said inner surface of said post means.

9. A device as recited in claim 2 in which said member includes a second flange at the lower edge of said depending flange, said second flange extending inwardly beneath said support surface, said second flange at each of said corners defining edges spaced from and immediately below said first and second edges for engaging said outer surfaces of said post means and cooperating with said first and second edges in forming a stable engagement between said member and said post means.

10. A device as recited in claim 9 in which said friction means engages said inner surface at a location intermediate said edges of said second flange and said first and second edges.

11. A device as recited in claim 2 in which said friction means at each of said corners includes a threaded member engageable with said inner surface of said post means.

12. A device as recited in claim 2 in which said friction means at each of said corners includes a nut member attached to said element, and a threaded shank extending through said nut member to said inner surface of said post means.

13. A device as recited in claim 2 in which said friction means at each of said corners includes a wedge means received in each of said openings, and means for causing said wedge means to bear against said inner surface of said post means.

14. A device as recited in claim 13 in which said wedge means includes upper and lower wedges, and a threaded member extending between said wedges for biasing said wedges toward each other.

15. A device as recited in claim 14 in which said wedge means includes an intermediate wedge between said upper and lower wedges, said intermediate wedge having upper and lower surface means engageable by said upper and lower wedges, respectively, for laterally biasing said intermediate wedge.

* * * * *